US009346266B2

(12) United States Patent
Miyata

(10) Patent No.: US 9,346,266 B2
(45) **Date of Patent: *May 24, 2016**

(54) LIQUID EJECTING HEAD AND LIQUID EJECTING APPARATUS

(71) Applicant: SEIKO EPSON CORPORATION, Tokyo (JP)

(72) Inventor: Yoshinao Miyata, Kita-Azumi-Gun (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/704,449

(22) Filed: May 5, 2015

(65) Prior Publication Data

US 2015/0231881 A1 Aug. 20, 2015

Related U.S. Application Data

(63) Continuation of application No. 14/480,903, filed on Sep. 9, 2014, now Pat. No. 9,050,804, which is a continuation of application No. 14/056,422, filed on Oct. 17, 2013, now Pat. No. 8,833,911, which is a continuation of application No. 13/422,187, filed on Mar. 16, 2012, now Pat. No. 8,596,767.

(30) Foreign Application Priority Data

Mar. 18, 2011 (JP) ..... 2011-060470

(51) Int. Cl.
*B41J 2/045* (2006.01)
*B41J 2/14* (2006.01)

(52) U.S. Cl.
CPC *B41J 2/14* (2013.01); *B41J 2/1433* (2013.01); *B41J 2002/14362* (2013.01); *B41J 2002/14491* (2013.01)

(58) Field of Classification Search
CPC .. B41J 2/1433; B41J 2/14; B41J 2002/14362; B41J 2002/14491; B41J 2002/14241; B41J 2002/14306; B41J 2002/14483
USPC ..... 347/68–72, 47
See application file for complete search history.

(56) References Cited

U.S. PATENT DOCUMENTS 5,208,604 A 5/1993 Watanabe et al.
5,682,187 A 10/1997 Watanabe et al.

(Continued)

FOREIGN PATENT DOCUMENTS

JP 02-187342 7/1990
JP 2000-177123 6/2000

(Continued)

*Primary Examiner* — Henok Legesse
(74) *Attorney, Agent, or Firm* — Workman Nydegger

(57) ABSTRACT

A liquid ejecting head includes: a nozzle plate provided with nozzle openings; an actuator unit including a flow channel formation substrate in which pressure generation chambers are provided and piezoelectric actuators that cause a change in the pressure of the liquid within respective pressure generation chambers; a communication substrate in which communication channels that communicate between the pressure generation chambers and corresponding nozzle openings are provided; a first case member that is a frame member affixed to the communication substrate so that the actuator unit is disposed within the first case member and that, along with the actuator unit, forms a manifold that holds the liquid to be supplied to the pressure generation chambers; and a second case member that is affixed to the first case member and in which is formed an introduction channel that sends the liquid from the exterior to the manifold.

10 Claims, 4 Drawing Sheets

(56) References Cited

U.S. PATENT DOCUMENTS

| | | | | |
|---|---|---|---|---|
| 7,152,963 | B2 * | 12/2006 | Owaki et al. | 347/68 |
| 8,596,767 | B2 * | 12/2013 | Miyata | B41J 2/14233 347/68 |
| 8,632,165 | B2 | 1/2014 | Akahane et al. | |
| 8,833,911 | B2 * | 9/2014 | Miyata | B41J 2/14233 347/65 |
| 8,899,724 | B2 | 12/2014 | Akahane et al. | |
| 9,050,804 | B2 * | 6/2015 | Miyata | B41J 2/14233 |
| 2004/0001124 | A1 | 1/2004 | Ito | |
| 2006/0290747 | A1 | 12/2006 | Shimada et al. | |
| 2007/0046727 | A1 * | 3/2007 | Yanagisawa et al. | 347/47 |
| 2007/0263041 | A1 | 11/2007 | Owaki | |
| 2009/0160907 | A1 * | 6/2009 | Owaki et al. | 347/44 |

FOREIGN PATENT DOCUMENTS

| | | |
|---|---|---|
| JP | 2004-025636 | 4/2004 |
| JP | 2005-246903 | 9/2005 |
| JP | 2006-076170 | 3/2006 |
| JP | 2006-212478 | 8/2006 |
| JP | 2007-301736 | 11/2007 |
| JP | 2009-166335 | 7/2009 |
| JP | 2009-233870 | 10/2009 |

* cited by examiner

LIQUID EJECTING HEAD AND LIQUID EJECTING APPARATUS

This application is a Continuation of U.S. application Ser. No. 14/480,903 filed Sep. 9, 2014, which is a Continuation of U.S. application Ser. No. 14/056,422 filed Oct. 17, 2013, and issued as U.S. Pat. No. 8,833,911 on Sep. 16, 2014, which is a Continuation of U.S. application Ser. No. 13/422,187 filed Mar. 16, 2012, and issued as U.S. Pat. No. 8,596,767 on Dec. 3, 2013, which claims priority to Japanese Patent Application No. 2011-060470 filed on Mar. 18, 2011 which applications are hereby expressly incorporated by reference herein in their entirety.

BACKGROUND

1. Technical Field

The present invention relates to liquid ejecting heads that eject liquid from a nozzle opening and liquid ejecting apparatuses, and particularly relates to ink jet recording heads that eject ink as a liquid and ink jet recording apparatuses.

2. Related Art

An ink jet recording head that includes a flow channel formation substrate in which a plurality of pressure generation chambers are formed along the lengthwise direction and piezoelectric actuators provided for the respective pressure generation chambers on one surface of the flow channel formation substrate, and that ejects ink droplets from respective nozzle openings by using displacement in the respective piezoelectric actuators to generate pressure inside the pressure generation chambers, exists as a representative example of a liquid ejecting head that ejects a liquid. Here, the nozzle openings are caused to correspond with respective pressure generation chambers, and are provided so as to pass through in the thickness direction thereof (for example, see JP-A-2006-212478 and JP-A-2009-233870). A nozzle plate is attached to the other surface of the flow channel formation substrate so as to seal an opening portion on the other sides of the pressure generation chambers. In other words, the nozzle plate is affixed directly to the other surface of the flow channel formation substrate.

However, the nozzle plate is a comparatively high-cost member, and is one cause of an increase in the cost of the ink jet recording head. Furthermore, although there are nozzle plates to which insulative water-repellent film is applied, doing so causes an even greater increase in costs.

In addition, the flow channel formation substrates are formed by first forming a plurality of flow channel formation substrates on a wafer for flow channel formation substrates, which are silicon single-crystal substrates, and then cutting out the flow channel formation substrates therefrom. Accordingly, it is vital to increase the yield of the flow channel formation substrates in order to achieve a reduction in the cost of the ink jet recording head. Accordingly, it is desirable to reduce the size of the flow channel formation substrates to the greatest extent possible.

However, in the ink jet recording head according to the past technique described above, a liquid holding portion that holds the ink supplied to the pressure generation chambers is also provided in the flow channel formation substrate, and thus there is a limit to the degree by which the size can be reduced; this poses a problem in that it interferes with the cost reduction.

It should be noted that these problems are not limited to ink jet recording heads that eject ink, and are also present in other liquid ejecting heads that eject liquids aside from ink.

SUMMARY

It is an advantage of some aspects of the invention to provide a liquid ejecting head capable of achieving a reduction in overall costs by reducing the size of a nozzle plate, reducing the size of members provided with a pressure generation chamber, and so on, and to provide a liquid ejecting apparatus that includes such a liquid ejecting head.

A liquid ejecting head according to an aspect of the invention includes: a nozzle plate provided with nozzle openings that eject a liquid; an actuator unit including a flow channel formation substrate in which pressure generation chambers that communicate with the respective nozzle openings are provided and pressure generation units that cause a change in the pressure of the liquid within the respective pressure generation chambers; a communication substrate, provided between the nozzle plate and the actuator unit, in which communication channels that communicate between the pressure generation chambers and corresponding nozzle openings are provided; a first case member that is a frame member affixed to the communication substrate so that the actuator unit is disposed within the first case member and that, along with the actuator unit, forms part of a liquid holding portion that holds the liquid to be supplied to the pressure generation chambers; and a second case member that is affixed to the first case member and in which is formed an introduction channel that sends the liquid from the exterior to the liquid holding portion.

According to this aspect, the surface of the liquid holding portion that faces the nozzle plate is defined by the communication substrate, and thus the nozzle plate can be formed having a narrow width. As a result, it is possible to reduce the surface area of the nozzle plate, which in turn makes it possible to reduce the cost of the nozzle plate. In particular, in the case where a water-repellent film is provided on the surface of the nozzle plate, the surface area of the high-cost water-repellent film can be reduced, which has a significant cost reduction effect. In addition, simply reducing the surface area of the metal or ceramic plate that serves as the material of the nozzle plate and has a comparatively high cost also contributes to the cost reduction of course.

Furthermore, according to this aspect, the liquid holding portion is formed between the inner circumferential surface of the frame member and the end surface of the actuator unit, and thus the actuator unit can also be reduced in size; this can also contribute to the cost reduction. In other words, when a plurality of flow channel formation substrates or the like are formed together on a single large-sized substrate such as a silicon wafer, reducing the size of the flow channel formation substrate or the like makes it possible to increase the yield, which in turn makes it possible to achieve a reduction in costs.

The overall liquid ejecting head can be assembled by stacking the respective components, such as the first and second case members, and thus not only can the positioning be carried out with ease, but the manufacturing process can be streamlined.

Furthermore, in this aspect, it is preferable for the liquid ejecting head to further include a sealing membrane that seals part of the liquid holding portion and that serves as a flexible portion that is at least partially flexible; here, it is preferable for the first case member to include a wall surface portion formed in the peripheral portion of the surface of the frame member on which the second case member is stacked, and for the second case member to include a main case body and the sealing membrane that forms the flexible portion and to be embedded in an internal space formed by the frame member so that the sealing membrane is sandwiched between the surface of the frame member on the stacked side and the main case body. In this case, the sealing membrane is anchored by sandwiching the sealing membrane between the main case body and the frame member, and thus a favorable seal can be ensured between the sealing membrane and the frame member.

Furthermore, it is desirable for the pressure generation unit of the actuator unit to be covered by a protective member, and for the protective member to face the liquid holding portion and include a cutout portion that opposes the flexible portion. Through this, the pressure generation unit can be protected, and the surface area of the flexible portion can be extended to the region corresponding to the cutout portion; this in turn makes it possible to provide a high compliance in this area.

Furthermore, another aspect of the invention is a liquid ejecting apparatus including the liquid ejecting head according to the aforementioned aspects.

According to this aspect, a liquid ejecting apparatus that improves the liquid ejection quality can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail hereinafter based on embodiments.

Figure 1A:
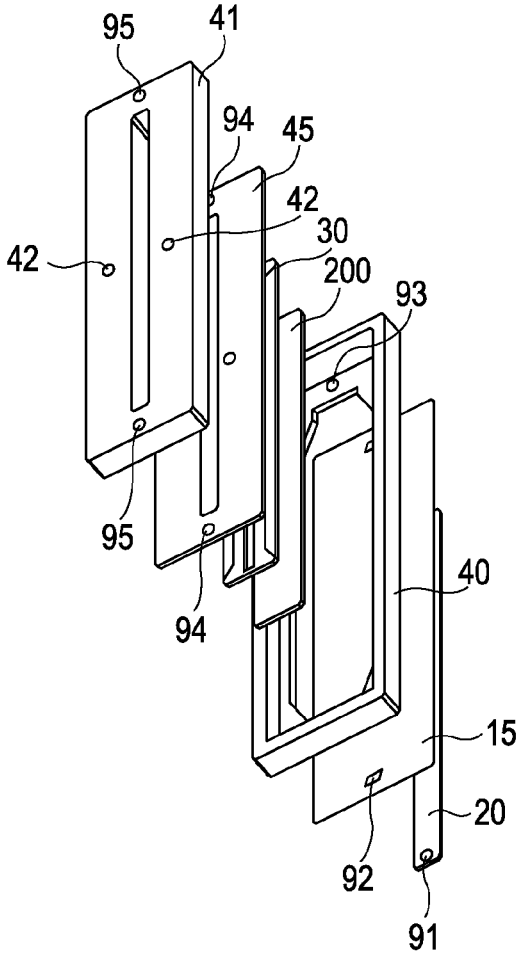
FIGS. 1A and 1B are exploded perspective views of a recording head according to an embodiment.
Figure 1B:
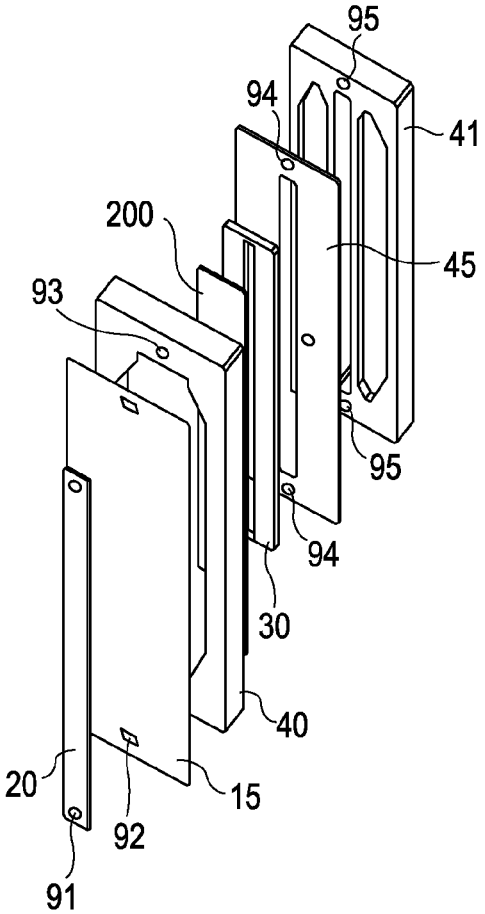
Figure 2:
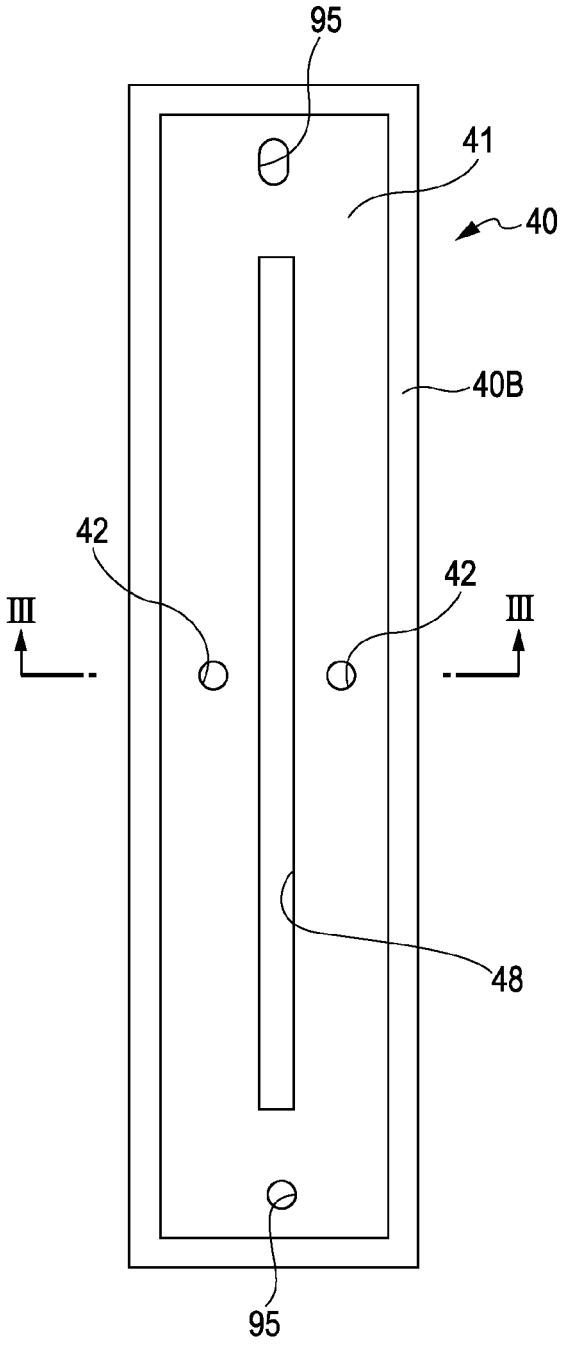
FIG. 2 is a plan view of the recording head according to the embodiment.
Figure 3A:
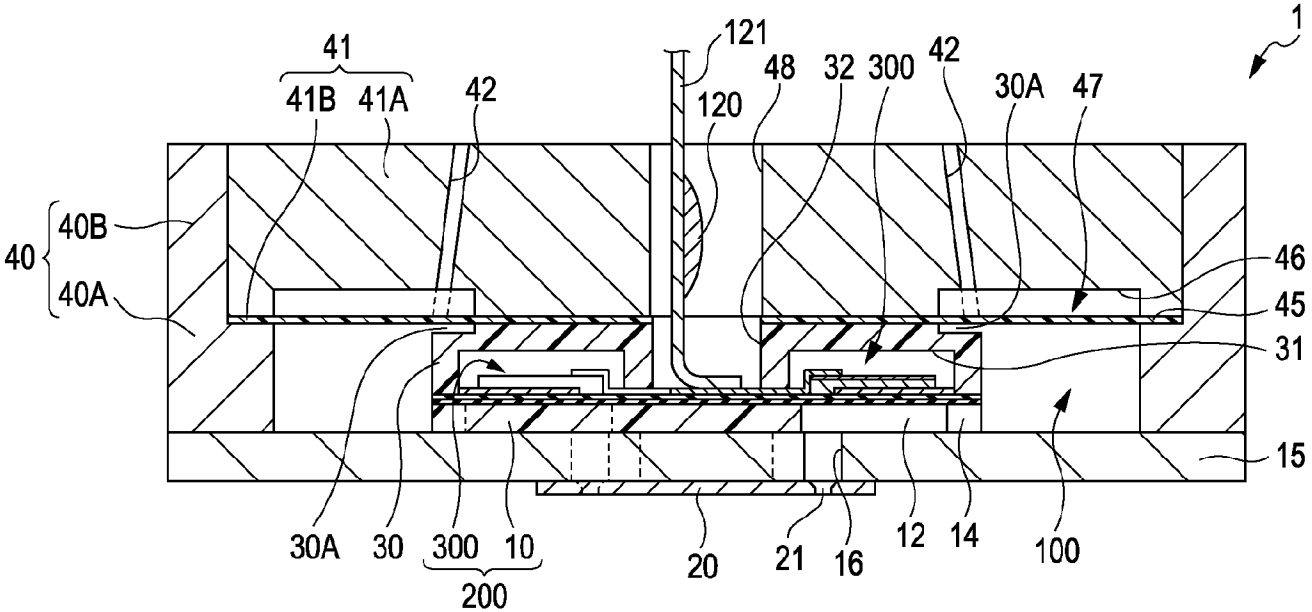
FIG. 3A is an enlarged cross-section viewed along the III-III line shown in FIG. 2.
Figure 3B:
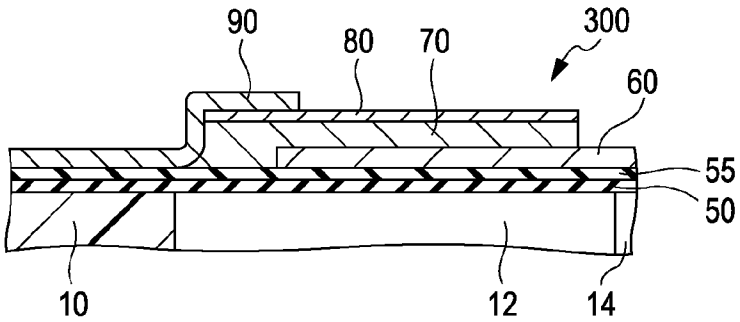
FIG. 3B is a cross-sectional view illustrating a part thereof in an enlarged manner.

FIGS. 1A and 1B are exploded perspective views of an ink jet recording head serving as an example of a liquid ejecting head according to an embodiment of the invention; FIG. 2 is a plan view thereof; and FIG. 3A is an enlarged cross-section viewed along the III-III line shown in FIG. 2, and FIG. 3B is an enlarged cross-sectional view focusing on an actuator unit portion.

As shown in these drawings, a flow channel formation substrate 10 is, in this embodiment, configured of a plane-oriented (110) silicon single-crystal substrate, and an elastic membrane 50, configured of silicon dioxide, is formed on one surface thereof. Two rows of a plurality of pressure generation chambers 12, with the pressure generation chambers 12 being arranged essentially on a straight line in each row, are formed in the flow channel formation substrate 10. Note that of the two rows of pressure generation chambers 12 arranged essentially on a straight line, the rows of the pressure generation chambers 12 are disposed relative to each other so that the position of one of the rows is shifted, relative to the other row, by half the space between adjacent pressure generation chambers 12 in the arrangement direction thereof. Accordingly, nozzle openings 21, which will be described in detail later, are also disposed so that two rows of nozzle openings 21 are shifted relative to each other by half the stated space, resulting in double the resolution.

Meanwhile, ink supply channels 14 are provided at one end of the flow channel formation substrate 10 in the lengthwise direction of the pressure generation chambers 12, and ink is supplied to the pressure generation chambers 12 via the ink supply channels 14 from a manifold 100, which is a liquid holding portion that is shared by the plurality of pressure generation chambers 12. Note that the ink supply channels 14 are formed so as to be narrower than the pressure generation chambers 12, and thus maintain the flow channel resistance for the ink that flows from the manifold 100 into the pressure generation chambers 12 at a constant resistance. Incidentally, in this embodiment, a plurality of individual flow channels that communicate with the manifold 100, which is a common flow channel, are configured by the pressure generation chambers 12 and the ink supply channels 14.

Meanwhile, a communication substrate 15 is provided on the opening surface side (that is, the opposite side as the elastic membrane 50) of the flow channel formation substrate 10, with an adhesive, a heat-welded film, or the like therebetween. Communication channels 16 that pass through in the thickness direction and communicate with corresponding pressure generation chambers 12 are provided in the communication substrate 15. The communication channels 16 are provided so as to communicate with the end, in the lengthwise direction of the pressure generation chambers 12, that is on the opposite side as the end that communicates with the ink supply channels 14. Furthermore, the communication channels 16 are provided individually for each of the pressure generation chambers 12. Accordingly, the communication channels 16 are also arranged essentially on a straight line, in the same manner as the rows configured of the pressure generation chambers 12. The pressure generation chambers 12 communicate with the nozzle openings 21 via these communication channels 16; details will be given later.

Furthermore, a nozzle plate 20 is provided on the communication substrate 15 that is on the opposite side of the flow channel formation substrate 10, with an adhesive, a heat-welded film, or the like. The nozzle openings 21 that communicate with corresponding pressure generation chambers 12 via corresponding communication channels 16 are provided in the nozzle plate 20. Note that the nozzle plate 20 is configured of a metal such as stainless steel, a glass ceramic, a silicon single-crystal substrate, or the like.

In this embodiment, the nozzle plate 20 is smaller than the communication substrate 15. The nozzle plate 20 is of a size that covers at least the openings of both rows of the communication channels 16 on the nozzle plate 20 side. Costs can be reduced by making the surface area of the nozzle plate 20 when planar-viewed from the ejection direction smaller than the surface area of the communication substrate 15 when planar-viewed from the ejection direction. Incidentally, although not shown here, a water-repellent film that repels water (repels liquid) is provided on the liquid ejection surface of the nozzle plate 20 (that is, the surface of the nozzle plate 20 that is on the opposite side as the communication substrate 15). Such a water-repellent film is expensive, and thus the cost of the nozzle plate 20 depends on the area of the surface on which the water-repellent film is formed. In this embodiment, the surface area of the nozzle plate 20 is reduced, which in turn reduces the surface area on which the water-repellent film is formed and makes it possible to reduce the cost of the nozzle plate 20. Of course, costs can be reduced simply by reducing the surface area of the metal, the ceramic, or the like that serves as the material of the nozzle plate 20.

Meanwhile, the elastic membrane 50 is formed on the opposite side of the opening surface of the flow channel formation substrate 10, as mentioned earlier; and an insulation film 55 configured of, for example, zirconium oxide is formed upon the elastic membrane 50. Furthermore, a first electrode 60, piezoelectric material layers 70, and second electrodes 80 are layered in sequence upon the insulation film 55 through deposition and lithography, thus configuring piezoelectric actuators 300. Here, "piezoelectric actuator 300" refers to the portion that includes the first electrode 60, the piezoelectric material layer 70, and the second electrode 80. Generally speaking, one of the electrodes in each piezoelectric actuator 300 serves as a common electrode, whereas the other electrode and the piezoelectric material layers 70 are configured through patterning carried out for each of the pressure generation chambers 12. In this embodiment, the first electrode 60 serves as the common electrode for each piezoelectric actuator 300 and the second electrode 80 serves as an individual electrode for the piezoelectric actuator 300; however, this may be reversed with no ill effects if required by a driving circuit, wiring pattern, and so on. Although the elastic membrane 50, the insulation film 55, and the first electrode 60 act as a vibrating plate in the stated example, it should be noted that the invention is of course not limited thereto; for example, the first electrode 60 alone may act as the vibrating plate, and the elastic membrane 50 and insulation film 55 may be omitted. Furthermore, the piezoelectric actuator 300 itself may essentially play the role of the vibrating plate as well.

A lead electrode 90 configured of, for example, gold (Au) is connected to each second electrode 80, which serves as the individual electrode for its corresponding piezoelectric actuator 300. A wiring board 121, such as a COF serving as a flexible wiring provided with a driving circuit 120 such as a driving IC chip, is connected to the lead electrode 90; signals from the driving circuit 120 are supplied to each piezoelectric actuator 300 via the corresponding wiring board 121 and lead electrode 90.

In this embodiment, the stated flow channel formation substrate 10 and piezoelectric actuators 300 configure actuator units 200.

A protective substrate 30, including holding portions 31 capable of securing a space in a region opposing corresponding piezoelectric actuators 300 that ensure no interference with the movement thereof, is affixed via an adhesive, a heat-welded film, or the like to the surface of the flow channel formation board 10 that faces the piezoelectric actuators 300. Cutout portions 30A that face the manifold 100 and are opposed to a sealing film 41B are formed in the protective substrate 30 according to this embodiment (the function of the cutout portions 30A will be described later).

Meanwhile, because the piezoelectric actuators 300 are formed within the holding portions 31, the piezoelectric actuators 300 are protected in a state in which there is almost no influence from the external environment. In this embodiment, two rows of the piezoelectric actuators 300 are provided in the width direction in correspondence with the two rows of pressure generation chambers 12 that are arranged in the width direction, and thus the holding portion 31 is provided so as to be common for each row of piezoelectric actuators 300 provided in the width direction, and the holding portions 31 are provided individually for each row of piezoelectric actuators 300.

Meanwhile, a through-hole 32 that passes through the protective substrate 30 in the thickness direction thereof is provided in the protective substrate 37 between the two holding portions 31. Ends of the lead electrodes 90 led out from the piezoelectric actuators 300 of the flow channel formation substrate 10 are extended so as to be exposed within the through-hole 32, and the lead electrodes 90 and wiring board 121 are electrically connected within the through-hole 32.

This protective substrate 30 is, in this embodiment, formed so as to have approximately the same size (surface area on the side that is affixed) as the flow channel formation substrate 10. Furthermore, although glass, a ceramic material, metal, resin, and so on can be given as examples of the material of the protective substrate 30, it is preferable for the protective substrate 30 to be formed of a material that has approximately the same thermal expansion rate as the flow channel formation substrate 10; in this embodiment, the protective substrate 30 is formed using a silicon single-crystal substrate, which is the same material as the flow channel formation substrate 10.

A first case member 40 according to this embodiment includes a rectangular frame portion 40A and a wall surface portion 40B formed so as to surround the external perimeter of the frame portion 40A. In other words, the first case member 40 is a box-shaped frame member having an L-shaped cross-section. Here, the surface of the communication substrate 15 that faces the flow channel formation substrate 10 is affixed to an opening portion on one of the surfaces of the frame portion 40A. The frame portion 40A is formed so that the height thereof is essentially the same as the height of the actuator unit 200, and the actuator unit 200 is disposed within the frame portion 40A. In other words, the flow channel formation substrate 10 of the actuator unit 200 is affixed to the communication substrate 15 in a central area of the internal space of the frame portion 40A. Accordingly, the manifold 100 that holds the ink for supplying to the pressure generation chambers 12 is defined to both sides of the actuator unit 200 between the inner circumferential surface of the frame portion 40A and the end surface of the actuator unit 200. Meanwhile, the communication substrate 15 has a surface area (on the surface that is affixed to the flow channel formation substrate 10) that is greater than that of the flow channel formation substrate 10, and has approximately the same outer edge shape as the first case member 40 when planar-viewed from the direction in which the liquid droplets are ejected.

A second case member 41 includes a main case portion 41A and a sealing film 41B configured of a flexible member; a structure that is stacked within the first case member 40 is achieved by embedding the main case portion 41A along with the sealing film 41B within the space formed by the wall surface portion 40B of the first case member 40. In other words, the sealing film 41B is sandwiched between the surface of the frame portion 40A of the first case member 40 that faces the second case member 41 and the main case portion 41A, and the surface thereof on the side of the manifold 100 faces the manifold 100. Here, the region of the main case portion 41A that is opposite to both the manifold 100 and the cutout portions 30A is a space portion 46 having a concave shape. In this region, the structure is such that the manifold 100 is sealed by the sealing film 41B, and the sealing film 41B is capable of bending and deforming. As a result, part of the second case member 41 side of the manifold 100 (that is, the side on the opposite side as the communication substrate 15) is a flexible portion 47 that is sealed only with the sealing film 41B and is capable of bending and deforming. In this manner, in this embodiment, the flexible portion 47 can be given a wide surface area that also includes a region corresponding to the cutout portions 30A, which makes it possible to ensure a compliance that is greater by that amount. Here, the sealing film 41B is configured of a flexible material having a low rigidity, such as polyphenylene sulfide (PPS) or the like.

Meanwhile, two introduction channels 42, which serve as passage channels that extend to the manifold 100 on both sides from the exterior, are formed in the second case member 41, and the ink is supplied to the manifold 100 via the introduction channels 42.

Furthermore, a connection port 48 that communicates with the through-hole 32 of the protective substrate 30 is provided in the second case member 41 so as to pass through in the thickness direction. The wiring board 121 that is inserted into this connection port 48 is inserted into the through-hole 32 of the protective substrate 30 and connected to the lead electrodes 90. The wiring board 121 is connected to external wires via the connector of a connection board (not shown), and predetermined printing signals are supplied to the lead electrodes from the external wires.

Note that, as is clear particularly from FIG. 1, positioning holes 91, 92, 93, 94, and 95 are provided on both ends in the lengthwise direction of the nozzle plate 20, the communication substrate 15, the first case member 40, a sealing membrane 45, and the second case member 41; when assembling the elements, the elements are stacked and assembled while positioning those elements by inserting positioning pins into the respective positioning holes 91 through 95.

In this embodiment, as described above, the manifold 100 is formed using the first case member 40, and thus the size of the flow channel formation substrate 10 and the protective substrate 30 can be reduced. In the case where, for example, the manifold is provided in the flow channel formation substrate, the protective substrate, or the like, the flow channel formation substrate and the protective substrate define the perimeter walls of the manifold, and thus the flow channel formation substrate and the protective substrate increase in size in the lengthwise direction of the pressure generation chambers. As opposed to this, in this embodiment, the end surfaces of the flow channel formation substrate 10 and the protective substrate 30 define one surface of the manifold 100 (in the lengthwise direction of the pressure generation chambers 12), while the other surface of the manifold 100 is defined by the inner circumferential surface of the frame portion 40A of the first case member 40; accordingly, the flow channel formation substrate 10 and the protective substrate 30 can be reduced in size. As a result, when a plurality of flow channel formation substrates 10 and protective substrates 30 are formed together on a single large-sized substrate such as a silicon wafer, reducing the size of the flow channel formation substrate 10 and the protective substrate 30 makes it possible to increase the yield from the large-sized substrate, which in turn makes it possible to reduce costs. Note that forming a plurality of flow channel formation substrates 10 and protective substrates 30 together on a large-sized substrate such as a silicon wafer makes it possible to form a plurality of flow channel formation substrates 10 and protective substrates 30 at the same time, which in turn makes it possible to reduce costs.

In addition, in this embodiment, the surface of the manifold 100 on the side of the nozzle plate 20 is defined by the communication substrate 15, and thus the nozzle plate 20 does not need to be of a size that overlaps with the manifold 100 in the stacking direction (the thickness direction). This makes it possible to reduce the surface area of the nozzle plate 20, which in turn makes it possible to reduce the cost of the nozzle plate 20.

With this ink jet recording head 1, ink supplied to the introduction channels 42 from an external ink liquid holding unit (not shown) is supplied to the pressure generation chambers 12 from the manifold 100. The piezoelectric actuators 300 corresponding to the pressure generation chambers 12 are then driven in accordance with the printing signals supplied from the driving circuit 120, and are caused to bend and deform. Through this, the volumes of the pressure generation chambers 12 are caused to change, which causes ink droplets to be ejected from the nozzle openings 21.

Other Embodiments

Although embodiments of the invention have been described thus far, the basic configuration of the invention is not intended to be limited to the aforementioned descriptions. For example, although the aforementioned embodiment describes the frame portion 40A and the wall surface portion 40B as having an integral shape so that the cross-sectional shape of the first case member 40 is an L shape and describes the second case member 41 as being embedded in the interior space formed by the wall surface portion 40B, the invention is not limited thereto. The configuration may be employed as well even if a structure in which the second case member 41 is simply layered upon the first case member 40, which is the frame portion 40A. However, employing a configuration as described in the aforementioned embodiment makes it possible to sandwich the sealing film 41B, which serves as the flexible portion of the second case member 41 and faces the manifold 100, between the main case portion 41A and the surface of the frame portion 40A of the first case member 40, which in turn makes it possible to maintain the sealed state of this area in a favorable manner.

Furthermore, although the cutout portions 30A are provided in the protective substrate 30, the cutout portions 30A are not absolutely necessary. However, providing the cutout portions 30A makes it possible to secure a greater surface area for the flexible portion 47, which serves as a region that is capable of bending and deforming; this in turn makes it possible to provide a high compliance in this area. Although the flexible portion 47 is formed of the sealing membrane 45 that is separate from the main case portion 41A, the second case member itself may be formed using an elastic member, or the portion that faces the manifold 100 may be formed of a flexible member. In sum, any configuration may be employed as long as the portion that faces the manifold 100 is capable of bending and deforming.

Although the aforementioned embodiment describes a silicon single-crystal substrate as an example of the flow channel formation substrate 10, the invention is not particularly limited thereto, and the material such as an SOI substrate, glass, metal, or the like may be used as well.

In addition, although thin-film type piezoelectric actuators 300 are described as being used as the pressure generation units that cause pressure changes in the pressure generation chambers 12 in the aforementioned embodiment, the invention is not particularly limited thereto; for example, a thick-film piezoelectric actuator formed through a method such as applying a green sheet, a longitudinally-vibrating piezoelectric actuator that extends and contracts in the axial direction, formed by alternately layering piezoelectric material and electrode formation material, and so on can be used as well. Moreover, a device in which heating elements are disposed within the pressure generation chambers and liquid is discharged from the nozzle openings due to bubbles forming as a result of the heat from the heating elements, a so-called electrostatic actuator that generates static electricity between a vibrating plate and an electrode, with the resulting static electricity force causing the vibrating plate to distort and liquid to be discharged from the nozzle openings, can also be used as the pressure generation units.

Figure 4:
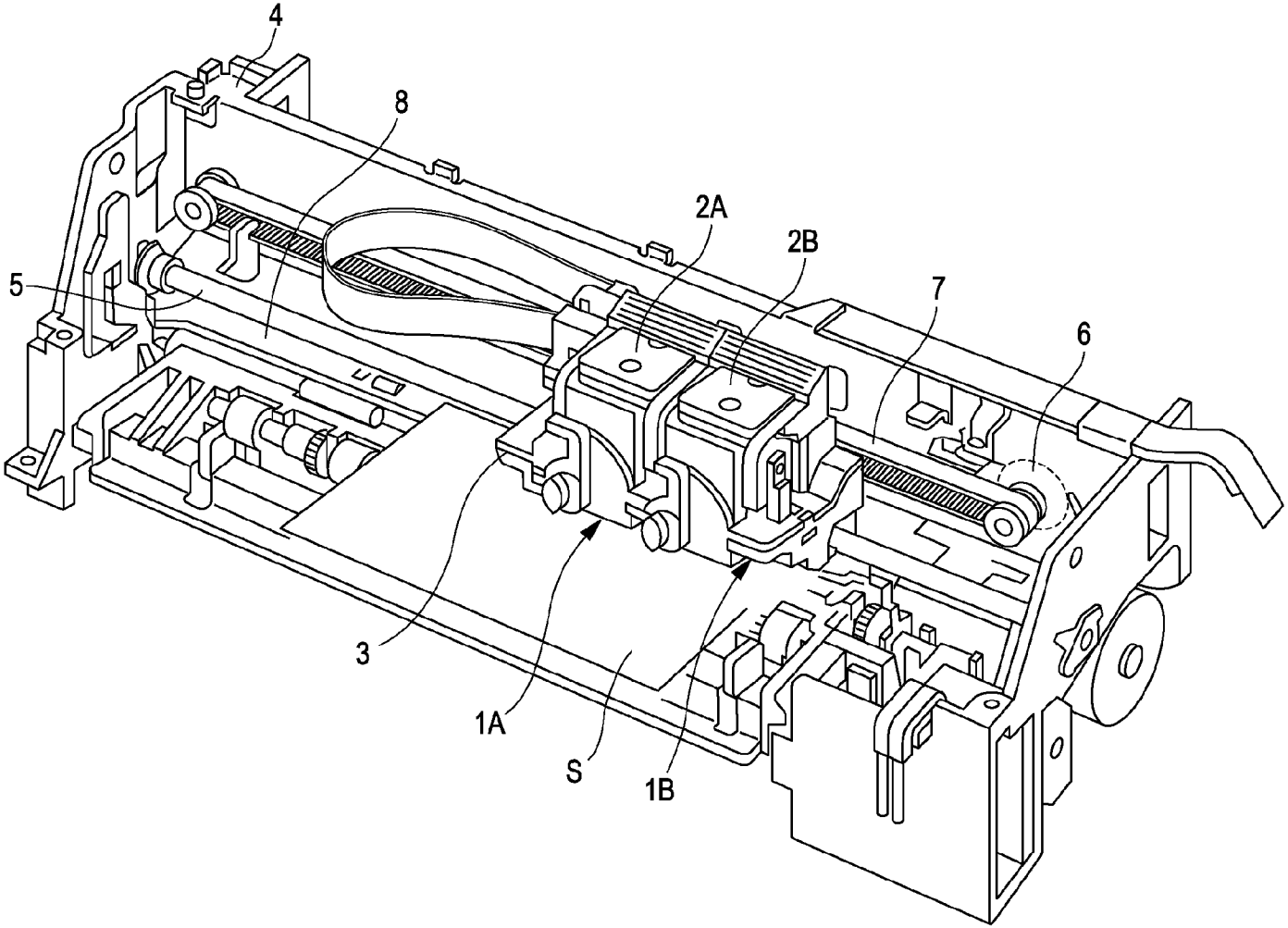
FIG. 4 is a diagram illustrating the overall configuration of a recording apparatus according to the embodiment.

The ink jet recording head according to the aforementioned embodiment configures part of a recording head unit including an ink flow channel that communicates with an ink cartridge or the like, and is installed in an ink jet recording apparatus. FIG. 4 is a general diagram illustrating an example of such an ink jet recording apparatus. As shown in FIG. 4, recording head units 1A and 1B that each include the ink jet recording head according to the aforementioned embodiment are provided with cartridges 2A and 2B, which configure ink supply units, in a removable state; a carriage 3 on which the recording head units 1A and 1B are mounted is provided so as to be capable of moving in the axial direction of a carriage shaft 5 that is attached to a main apparatus unit 4. These recording head units 1A and 1B each eject, for example, black ink compositions and color ink compositions.

Transmitting driving force generated by a driving motor 6 to the carriage 3 via a plurality of gears (not shown) and a timing belt 7 moves the carriage 3, in which the recording head units 1A and 1B are installed, along the carriage shaft 5. Meanwhile, a platen 8 is provided in the main apparatus unit 4 along the same direction as the carriage shaft 5, and a recording sheet S, which is a recording medium such as paper supplied by paper supply rollers and the like (not shown), is entrained and transported by the platen 8.

Although the aforementioned example describes what is known as a serial type ink jet recording apparatus, in which the recording head units 1A and 1B are mounted in the carriage 3 that moves in the direction orthogonal to the transport direction of the recording sheet S (that is, the main scanning direction) and printing is carried out while moving the recording head units 1A and 1B in the main scanning direction, the invention is not limited thereto. What is known as a line type ink jet recording apparatus, in which the recording head is fixed and printing is carried out while only transporting the recording sheet S, may of course be employed as well.

Furthermore, although the aforementioned embodiment describes an ink jet recording apparatus as an example of a liquid ejecting apparatus, the invention is directed at all types of liquid ejecting apparatuses that include liquid ejecting heads, and of course can also be applied in liquid ejecting apparatuses including liquid ejecting heads that eject liquids aside from ink. Various types of recording heads used in image recording apparatuses such as printers, coloring material ejecting heads used in the manufacture of color filters for liquid-crystal displays and the like, electrode material ejecting heads used in the formation of electrodes for organic EL displays, FEDs (field emission displays), and so on, bioorganic matter ejecting heads used in the manufacture of biochips, and so on can be given as other examples of liquid ejecting heads.

What is claimed is:

1. A liquid ejecting head comprising:

a plate comprising holes;

a flow channel formation substrate comprising:

a surface affixed to the plate, and pressure generation chambers, each pressure generation chamber in communication with one of the holes;

a first case, discrete from the flow channel formation substrate, comprising a surface affixed to the plate, wherein the first case and the flow channel formation substrate are arranged to form a liquid holding portion, the liquid holding portion in communication with the pressure generation chambers;

a second case affixed to a portion of the first case, wherein liquid is delivered to the liquid holding portion through an opening in the second case; and pressure generation units configured to cause changes in a pressure of liquid within the pressure generation chambers and eject the liquid through the holes, wherein the flow channel formation substrate is surrounded by the first case in a plane parallel to the plate.

2. The liquid ejecting head according to claim 1, wherein the second case comprises an inside surface and an outside surface each configured to form the liquid holding portion, the inside surface provided above the flow channel formation substrate, the outside surface provided above the first case.

3. The liquid ejecting head according to claim 1, wherein the second case is affixed to the flow channel formation substrate defining a holding portion configured to protect the pressure generation units from an external environment.

4. The liquid ejecting head according to claim 1, further comprising:

a protective substrate comprising a top surface affixed to the flow channel formation substrate, and configured to form the liquid holding portion.

5. The liquid ejecting head according to claim 4, wherein the protective substrate is approximately as large as the flow channel formation substrate in a plane view from a thickness direction of the protective substrate.

6. The liquid ejecting head according to claim 1, wherein the plate is larger than the flow channel formation substrate in a plane view from a thickness direction of the plate.

7. The liquid ejecting head according to claim 1, wherein the flow channel formation substrate comprises an inside surface configured to form the liquid holding portion, the first case comprises an outside surface configured to form the liquid holding portion, the outside surface farther from the holes than the inside surface, the outside surface facing toward the inside surface.

8. The liquid ejecting head according to claim 1, wherein the surface of the flow channel formation substrate is adhered to the plate by an adhesive.

9. The liquid ejecting head according to claim 1, wherein the surface of the first case is adhered to the plate by an adhesive.

10. The liquid ejecting head according to claim 1, wherein the first case member is taller than the flow channel formation substrate from the plate.

* * * * *